United States Patent [19]

Terlecke

[11] Patent Number: 4,915,343

[45] Date of Patent: Apr. 10, 1990

[54] ARRANGEMENT FOR MOUNTING A DEVICE ON A WALL

[75] Inventor: Mark J. Terlecke, Madison, Wis.

[73] Assignee: Graber Industries, Inc., Middleton, Wis.

[21] Appl. No.: 859,495

[22] Filed: May 5, 1986

[51] Int. Cl.[4] ..... A47H 1/14

[52] U.S. Cl. ..... 248/546; 248/222.4; 248/251; 411/60; 411/72; 411/908

[58] Field of Search ..... 248/542, 544, 546, 216.1, 248/217.2, 222.4, 251; 411/57, 60, 72, 908

[56] References Cited

U.S. PATENT DOCUMENTS

| | | | |
|---|---|---|---|
| 1,850,616 | 3/1932 | Barnett | 248/542 |
| 1,940,888 | 12/1933 | Smith | 248/251 |
| 1,962,739 | 6/1934 | Hoegger | 248/251 |
| 2,636,633 | 4/1953 | Carlson | 248/222.4 |
| 2,688,901 | 9/1954 | Haugaard | 248/222.4 |
| 3,317,167 | 5/1967 | Becker | 248/222.4 |
| 3,487,446 | 12/1969 | Hero | 248/222.4 |
| 4,094,054 | 6/1978 | Fischer | 411/57 |
| 4,460,147 | 7/1984 | Macbain | 248/222.4 |

FOREIGN PATENT DOCUMENTS

| | | | |
|---|---|---|---|
| 733163 | 7/1955 | United Kingdom | 248/222.4 |

*Primary Examiner*—Ramon O. Ramirez
*Assistant Examiner*—Robert A. Olson
*Attorney, Agent, or Firm*—Vernon J. Pillote

[57] ABSTRACT

An arrangement for mounting a device on a wall in which the device includes a wall mounting pad having at least two fastener receiving openings. A plastic base plate is provided with at least two integral screw anchors that extend transverse to the rear side of the base plate at locations corresponding to the spaced locations of the fastener receiving openings in the mounting pad. Screw fasteners are adapted to be screwed into the wall anchor to expand the wall anchors into firm engagement with the opening in the wall and to provide mounting fasteners for attaching the mounting pad to the base plate.

12 Claims, 2 Drawing Sheets

Fig. 1.
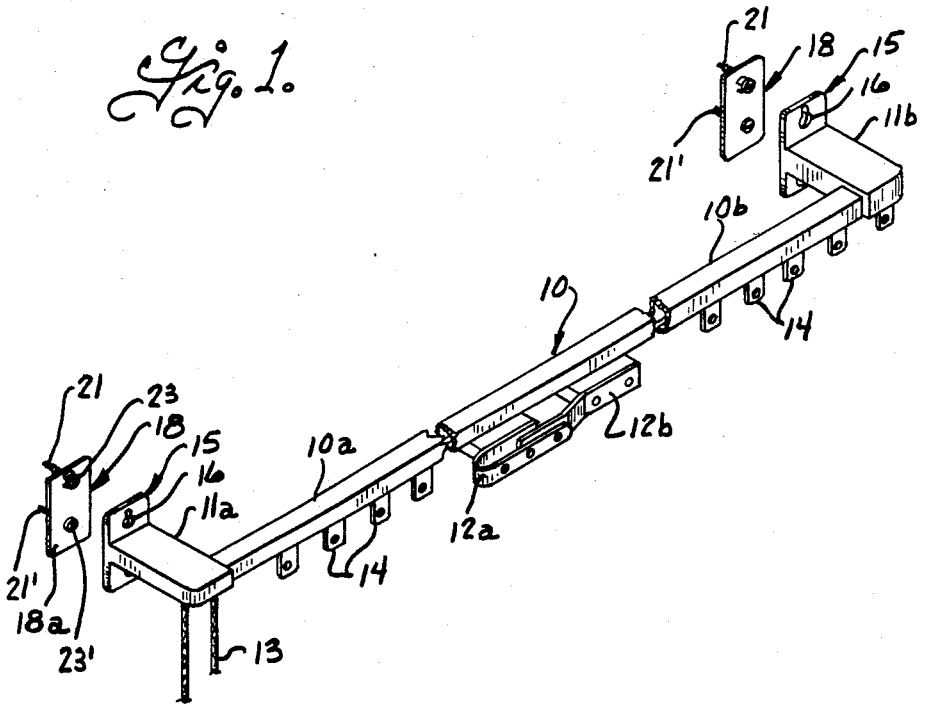
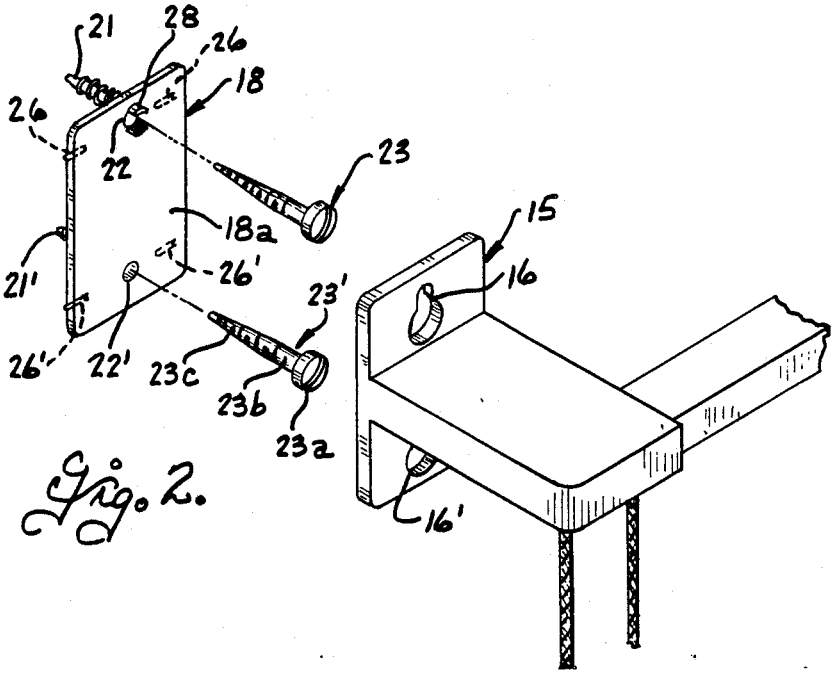
Fig. 2.

Fig. 3.
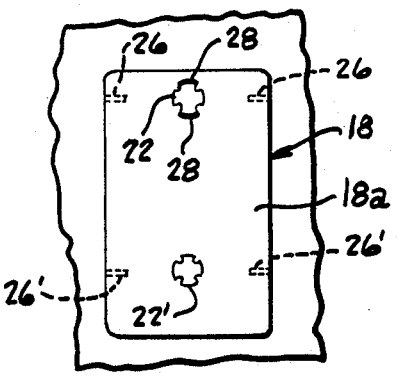
Fig. 4.
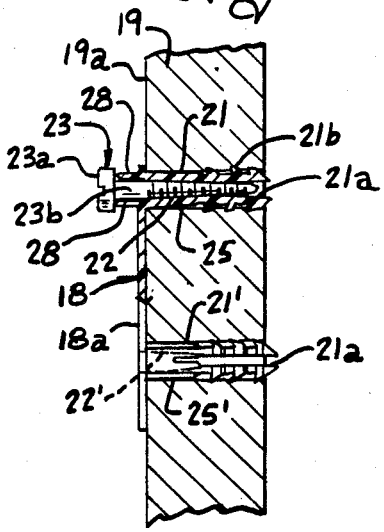
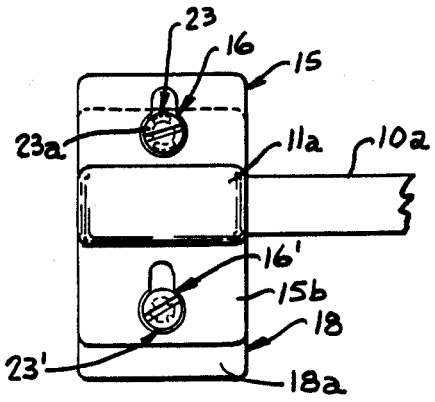
Fig. 5.
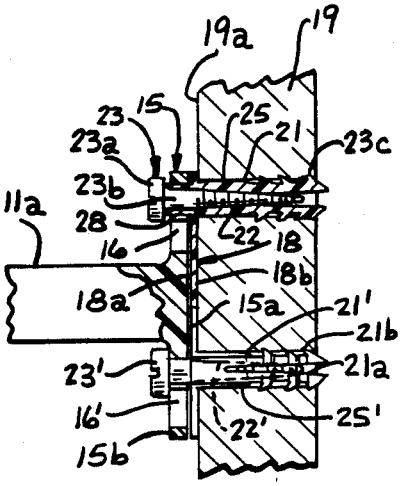
Fig. 6.

ARRANGEMENT FOR MOUNTING A DEVICE ON A WALL

BACKGROUND OF THE INVENTION

It is common practice to use plastic screw anchors to mount devices such as drapery rods on a wall support surface. In general, the plastic screw anchors are formed with an axially elongated body adapted to be inserted into a hole drilled into a wall and the screw anchors have a screw receiving passage extending inwardly from one end. The plastic screw anchors are constructed and arranged so that a screw threaded to the screw receiving passage expands the anchor into firm engagement with the wall around the hole. Such screw anchors sometimes tend to turn in the hole during screwing of the screw into the anchor, particularly if the hole in the wall is a little oversized for the anchor or if the wall is formed of a soft material. Further, some devices have mounting pads with two or more fastener receiving openings to provide additional support for the device and to inhibit turning of the mounting pad on the wall, and some problems are presented in properly locating multiple screw anchors to register with the screw receiving openings in the mounting pad. In addition, some elongated devices such as drapery rods, have mounting brackets adjacent opposite ends with two or more fastener receiving openings in the mounting pad of each wall bracket, and it has heretofore been difficult for one person to install such elongated devices with multiple mounting screws and screw anchors at each end of the device.

SUMMARY OF THE INVENTION

It is an object of the present invention to overcome the disadvantages of the prior art by providing an arrangement for mounting a device on a wall which accurately controls spacing between two or more screw anchors and prevents turning of the screw anchors in the wall during screwing of the mounting screw into the screw anchors.

Another object of this invention is to provide an arrangement for mounting elongated devices on a wall in which the elongated devices have a mounting pad at each end and which facilitates installation of the elongated device by one person and minimizes defacing of the wall during installation.

Accordingly, the present invention provides an arrangement for mounting a device on the wall, the device including a wall mounting pad having a rear face and a front face and at least first and second fastener receiving openings extending through the mounting pad at preselected spaced locations. The mounting arrangement includes a base plate formed of plastic and having a front side adapted to engage the rear face of the mounting pad and a rear side adapted to engage the wall surface and at least first and second axially elongated screw anchors integral with the base plate with their lengthwise axes extending transverse of the rear side of the base plate at locations corresponding to the preselected spaced locations of the first and second fastener receiving openings in the mounting pad. The base plate has first and second screw receiving passage means opening at the front side of the base plate and extending through the base plate and into the respective first and second axially elongated screw anchor. Screw fasteners individual to each screw receiving passage and having a head at one end and a shank with screw threads, are adapted to be screwed into respective one of the screw passages and the screw anchors are adapted to expand when the screw anchors are threaded into the screw receiving passage.

Since the screw anchors are formed integrally with the base plate, the spacing of the screw anchors can be accurately controlled and the screw anchors are prevented from turning about their axes when the fastening screws are screwed into the anchors.

The arrangement is also adapted for use in mounting elongated devices in which a mounting bracket adjacent each end of the device has a mounting pad with at least two fastener receiving openings. Base plates for each mounting bracket can be first installed on the wall and anchored with at least one screw fastener. One end of the elongated device can then be raised and the mounting bracket at that end supported on a screw fastener associated with one of the base plates. The other end of the elongated device can thereafter be raised and the mounting bracket at that end then assembled on a screw fastener associated with the other base plate.

BRIEF DESCRIPTION OF THE DRAWINGS

FIG. 1 is a perspective view of an arrangement for mounting a device on a wall embodying the present invention;

FIG. 2 is a fragmentary exploded perspective view of an arrangement for mounting a device on a wall;

FIG. 3 is a front view of the base plate;

FIG. 4 is a sectional view through a wall having the base plate installed thereon;

FIG. 5 is a fragmentary front view illustrating assembly of the device on the base plate; and FIG. 6 is a fragmentary vertical sectional view through a wall showing the device assembled on the base plate.

The present invention relates to an arrangement for mounting devices on a wall and particularly for mounting devices of the type which require two or more mounting screws in order to provide adequate support for the device. The arrangement is particularly adapted for mounting elongated devices such as drapery rods and the like on a wall surface and is herein specifically illustrated and described in connection with a drapery rod device.

Referring more specifically to FIG. 1, the drapery rod includes an elongated drapery rod track 10 preferably formed with telescoping inner and outer sections 10*a* and 10*b* and having end brackets 11*a* and 11*b* at opposite ends. As is conventional, master carriers 12*a*, 12*b* are mounted for sliding movement along the drapery rod track and operated by draw cords 13, and a plurality of auxiliary carriers 14 are mounted for movement along the track to support a drapery panel (not shown) at locations intermediate each master carrier in the associated end of the rod. Each end bracket 11*a*, 11*b* has a wall mounting pad 15 and each mounting pad has a rear face 15*a* and a front face 15*b* and at least first and second fastener receiving openings 16 and 16' extending through the mounting pad at preselected spaced locations. As will be seen from FIG. 1, the rear and front faces on the mounting pad are disposed in generally upright planes paralleling the lengthwise dimension of the track 10.

A base plate 18 is provided for mounting each end bracket 11*a*, 11*b*. The base plates are conveniently of like construction and like numerals are used to designate corresponding parts. The base plates are formed of plastic and have a flat front side 18a adapted to engage the rear face 15a (FIG. 6) of the mounting pad and a rear side 18b adapted to engage the face 19a of a support surface such as wall 19. At least two axially elongated screw anchors designated 21 and 21' are formed integrally with the base plate with their lengthwise axes extending transverse to the rear side of the base plate at locations corresponding to the preselected spaced locations of the first and second fastener receiving openings 16, 16' in the associated mounting pad 15. First and second screw receiving passages 22, 22' are formed in the base plate. The passages open at the front side 18a and extend through the base plate and into the respective first and second axially elongated screw anchors 21, 21'. Screw fasteners 23, 23' are provided for the screw anchors 21, 21' and each includes an enlarged head 23a and a shank 23b having a tapered end portion 23c and external threads at least on the tapered end portion. The screw fasteners can be conventional wood screws or sheet metal screws. Each screw fastener is adapted to be screwed into a respective one of the screw receiving passages and the screw anchors are constructed and arranged to expand when the screw fastener is threaded thereinto. The base plate and integral screw anchors are formed of a deformable plastic material such as is used in the production of conventional individual screw anchors, and the screw anchors can be formed in any suitable manner which will adapt the anchors to laterally expand when the screw is threaded thereinto to firmly engage the hole in the wall 19. The screw anchors may, for example, be formed with slots or grooves 21a that extend into the screw anchor from the distal end thereof to divide the screw anchor into lengthwise extending laterally expansible segments. Alternatively, the screw anchors can be formed so as to axially compress and radially expand when the screw is threaded thereinto. As is conventional, lateral projections or ribs 21b can be formed on the outer periphery of the screw anchors to give the screw anchor greater gripping power against axial withdrawal. As is also conventional in the art, the screw receiving passage 22, 22' preferably taper inwardly from the mounting plate so that the inner end portion of the screw anchors expands to a greater extent than the portion adjacent the mounting plate.

The face plate is mounted on the wall 19 by first drilling one hole 25 in the wall of a size to snugly receive one of the screw anchors and at a location where it is desired to attach the mounting plate of the device. A second hole 25' is thereafter drilled in the wall of a size to snugly receive the other of the screw anchors. In order to facilitate locating the second hole in proper spaced relation to the first hole, first and second indicator marks 26, 26' (FIGS. 2 and 3) are advantageously provided on the base plate adjacent one edge, at locations transversely aligned with the center line of the screw receiving anchors 21, 21'. One indicator mark 26 can then be aligned with the center of the first hole 25, and the second indicator mark 26' then utilized in locating and marking a center for drilling the second hole 25'. The indicator marks 26, 26' are preferably formed at the rear side of the base plate so that they are concealed when the base plate is in use, and extend to the edge of the base plate. The indicator marks can be provided on both edges of the base plate as shown in FIGS. 2 and 3.

At least one and preferably at least both of the openings 16, 16' in the mounting pad are formed with a key-hole shape with an enlarged lower portion dimensioned to allow the head 23 of the screw fastener to pass therethrough and a narrower upper portion that opens at its lower end into the enlarged lower portion, and which is dimensioned to receive the shank of the screw fastener. With this arrangement, at least one screw fastener such as 23 can be screwed into the screw receiving passage 22' in one of the screw anchors 21 to a position in which the head of the screw is spaced from the base plate a distance slightly greater than the thickness of the mounting pad, and the mounting pad then assembled onto the base plate over the head of the screw fastener. In order to facilitate threading of the screw into the wall anchor to the appropriate depth, deformable screw position indicator means are provided on the front of the base plate adjacent one screw receiving opening. The screw position indicator means are advantageously in the form of one or more thin deformable projections 28 formed integrally with the base plate and which extend from the front side thereof adjacent the screw receiving opening 22 at a location to engage the underside of the head 23a on the screw fastener. The projections 28 extend from the front side of the base plate a distance at least equal to and preferably slightly greater than the thickness of the mounting pad, to indicate when the screw head is spaced from the base plate a distance sufficient to receive the mounting pad. The projections are made sufficiently thin so as to deform when the screw is thereafter tightened to lock the mounting pad in position.

The second screw fastener can be threaded into the screw receiving opening in the second wall anchor before assembling the mounting pad on the base plate or, alternatively, can be threaded into the screw receiving opening after the base plate is assembled onto the first screw fastener. In elongated devices such as the drapery rods illustrated in FIG. 1 having spaced mounting pads, it is desirable to mount one end of the rod while the other end rests on the floor, and thereafter mount the other end of the rod. In such installations, the base plates for both mounting pads can be mounted at appropriate locations on the wall and at least one screw fastener such as 23 threaded into one of the screw receiving passages and into one wall anchor to a depth as indicated in FIG. 4, to anchor the base plate on the wall. The second screw fastener for each base plate can be either threaded into the other screw receiving passage to a position in which the head abuts the front side of the base plate, or installation of the second screw fastener can be delayed until after the elongated device is mounted at both ends. One end of the elongated device can be then raised and the mounting pad at that end installed over the head of the screw fastener 23. The other end of the elongated device can thereafter be raised and the mounting pad at the other end of the elongated device then assembled over the head on the screw fastener 23 on the other base plate. This provides a temporary support for the elongated device on the wall and, if the second screw 23' in each mounting pad has previously been installed to its full depth, each mounting pad can be lifted slightly and the second screw unthreaded through the enlarged portion of the second screw receiving opening 16', after which the mounting pad is lowered to allow the narrower portions to pass below the heads on the screw. The first and second screws are thereafter tightened to firmly lock the mounting pad in position on the base plate. Alternatively, the second screws 23' can be inserted through the second opening 16' in the mounting pad and threaded into the screw receiving passages 22' after the elongated device is supported on the first mentioned screws.

The base plate is preferably made of a size and shape approximating that of the mounting pad and such as to extend to the outer perimeter of the mounting pad portion of the device, to provide firm support for the mounting pad and also enable the mounting pad to substantially conceal the base plate.

Since the multiple wall anchors are formed integrally with the respective base plate, the spacing between the wall anchors can be accurately controlled to align with the openings in the mounting pad when the device is installed. Further, the base plate with multiple wall anchors prevents turning of the wall anchors and base plate when the screws are threaded into the wall anchors. In addition, the base plate inhibits scuffing and defacing of the wall surface during assembly of the mounting pads on the mounting screws.

The embodiments of the invention in which an exclusive property or privilege is claimed are defined as follows:

1. An arrangement for mounting a device on a wall, the device including a wall mounting pad having a rear face and a front face and at least first and second fastener receiving openings extending through the mounting pad at preselected spaced locations, a base plate formed of plastic and having a front side adapted to engage the rear face of the mounting pad and a rear side adapted to engage a wall surface and at least first and second axially elongated screw anchors integral with the base plate with their lengthwise axes extending transverse to the rear side of the base plate at locations corresponding to said preselected spaced locations of the first and second fastener receiving openings in the mounting pad, the base plate having first and second screw receiving passage means opening at the front side of the base plate and extending through the base plate and into the respective first and second axially elongated screw anchors, a screw fastener individual to each screw receiving passage and each having a head at one end and a shank with screw threads, each screw fastener being adapted to be screwed into a respective one of the screw receiving passages and the screw anchors being adapted to expand when the screw fastener is threaded thereinto.

2. An arrangement for mounting a device on a wall according to claim 1 wherein at least one of the fastener receiving openings in the mounting pad has a key-hole shape whereby one of the screw fasteners can be threaded in one of the screw receiving passages to a position in which its head is spaced from the front side of the base plate and the mounting pad thereafter assembled onto the base plate over the head of said one screw fastener.

3. An arrangement for mounting a device on a wall according to claim 1 wherein said first and second fastener receiving openings each have a key-hole shape.

4. An arrangement for mounting a device on a wall according to claim 1 wherein the base plate has a size to extend to the perimeter of the rear face of the mounting pad when the mounting pad is assembled thereon.

5. An arrangement for mounting a device on a wall, the device including a wall mounting pad having a rear face and a front face and at least first and second fastener receiving openings extending through the mounting pad at preselected spaced locations, a base plate formed of plastic and having a front side adapted to engage the rear face of the mounting pad and a rear side adapted to engage a wall surface and at least first and second axially elongated screw anchors integral with the base plate with their lengthwise axes extending transverse to the rear side of the base plate at locations corresponding to said preselected spaced locations of the first and second fastener receiving openings in the mounting pad, the base plate having first and second screw receiving passage means opening at the front side of the base plate and extending through the base plate and into the respective first and second axially elongated screw anchors, a screw fastener individual to each screw receiving passage and each having a head at one end and a shank with screw threads, each screw fastener being adapted to be screwed into a respective one of the screw receiving passages and the screw anchors being adapted to expand when the screw fastener is threaded thereinto, and deformable screw position indicator means integral with the base plate and projecting from the front side thereof adjacent one screw receiving passage for indicating when the head of a screw fastener is spaced from the front side of the base plate a preselected distance greater than the thickness of the mounting pad.

6. An arrangement for mounting a device on a wall, the device including a wall mounting pad having a rear face and a front face and at least first and second fastener receiving openings extending through the mounting pad at preselected spaced locations, a base plate formed of plastic and having a front side adapted to engage the rear face of the mounting pad and a rear side adapted to engage a wall surface and at least first and second axially elongated screw anchors integral with the base plate with their lengthwise axes extending transverse to the rear side of the base plate at locations corresponding to said preselected spaced locations of the first and second fastener receiving openings in the mounting pad, the base plate having first and second screw receiving passage means opening at the front side of the base plate and extending through the base plate and into the respective first and second axially elongated screw anchors, a screw fastener individual to each screw receiving passage and each having a head at one end and a shank with screw threads, each screw fastener being adapted to be screwed into a respective one of the screw receiving passages and the screw anchors being adapted to expand when the screw fastener is threaded thereinto, the base plate having at least one edge parallel to a plane through the axes of the first and second screw receiving anchors, first and second indicator marks on the base plate adjacent at least said one edge and spaced apart a distance equal to the spacing of the first and second screw receiving passages to facilitate measurement of the spacing of the anchor receiving holes to be made in a wall.

7. An arrangement for mounting an elongated device on a wall, the elongated device having end brackets adjacent opposite ends, each end bracket including a mounting pad having a rear face and a front face and at least a first and second fastener receiving openings at preselected spaced locations, a base plate individual to each end bracket, each base plate being formed of plastic and having a front side adapted to engage the rear face of the mounting pad and a rear side adapted to engage a wall surface and at least first and second axially elongated screw anchors integral with the base plate with their lengthwise axes extending transverse to the rear side of the base plate at locations correlative with said preselected locations of said first and second fastener receiving openings in the mounting pad, the base plate having first and second screw receiving passages opening at the front side of the base plate and extending through the base plate and into the respective axially elongated screw anchor, a screw fastener individual to each screw receiving passage and each having a head at one end and a shank with screw threads, each screw fastener being adapted to be screwed into a respective one of the screw receiving passages and the screw anchors being adapted to expand when a screw fastener is threaded thereinto.

8. The combination of claim 7 wherein at least one of the fastener receiving openings in each mounting pad has a key-hole shape whereby one of the screw fasteners can be threaded in one of the screw receiving passages to a position in which its head is spaced from the front side of the base plate and the mounting pad thereafter assembled onto the base plate over the head of said one screw fastener.

9. The combination of claim 7 wherein the first and second fastener receiving openings in each mounting pad each have a key-hole shape.

10. The combination of claim 7 wherein each base plate has a size to extend to the perimeter of the rear face of the associated mounting pad.

11. An arrangement for mounting an elongated device on a wall, the elongated device having end brackets adjacent opposite ends, each end bracket including a mounting pad having a rear face and a front face and at least first and second fastener receiving openings at preselected spaced locations, a base plate individual to each end bracket, each base plate being formed of plastic and having a front side adapted to engage the rear face of the mounting pad and a rear side adapted to engage a wall surface and at least first and second axially elongated screw anchors integral with the base plate with their lengthwise axes extending transverse to the rear side of the base plate at locations correlative with said preselected locations of said first and second fastener receiving openings in the mounting pad, the base plate having first and second screw receiving passages opening at the front side of the base plate and extending through the base plate and into the respective axially elongated screw anchor, a screw fastener individual to each screw receiving passage and each having a head at one end and a shank with screw threads, each screw fastener being adapted to be screwed into a respective one of the screw receiving passages and the screw anchors being adapted to expand when a screw fastener is threaded thereinto, and deformable screw position indicator means integral with each base plate and projecting from the front side thereof adjacent one of the screw receiving passages for indicating when the head of one screw fastener is spaced from the front side of the base plate a preselected distance greater than the thickness of the mounting pad.

12. An arrangement for mounting an elongated device on a wall, the elongated device having end brackets adjacent opposite ends, each end bracket including a mounting pad having a rear face and a front face and at least first and second fastener receiving openings at preselected spaced locations, a base plate individual to each end bracket, each base plate being formed of plastic and having a front side adapted to engage the rear face of the mounting pad and a rear side adapted to engage a wall surface and at least first and second axially elongated screw anchors integral with the base plate with their lengthwise axes extending transverse to the rear side of the base plate at locations correlative with said preselected locations of said first and second fastener receiving openings in the mounting pad, the base plate having first and second screw receiving passages opening at the front side of the base plate and extending through the base plate and into the respective axially elongated screw anchor, a screw fastener individual to each screw receiving passage and each having a head at one end and a shank with screw threads, each screw fastener being adapted to be screwed into a respective one of the screw receiving passages and the screw anchors being adapted to expand when a screw fastener is threaded thereinto, the base plate having at least one edge parallel to a plane through the axes of the first and second screw receiving anchors, first and second indicator marks on the base plate adjacent at least said one edge and spaced apart a distance equal to the spacing of the first and second screw receiving openings to facilitate measurement of the spacing of anchor receiving holes to be made in a wall.

* * * * *